US009205341B2

(12) United States Patent
Higuchi et al.

(10) Patent No.: US 9,205,341 B2
(45) Date of Patent: Dec. 8, 2015

(54) ACTION FIGURE WITH ACCESSORIES

(75) Inventors: Terence J Y. Higuchi, Redondo Beach, CA (US); Kit Hong Lau, Wan Chai (HK); J. Austin Rucker, Redondo Beach, CA (US)

(73) Assignee: MATTEL, INC., El Segundo, CA (US)

( * ) Notice: Subject to any disclaimer, the term of this patent is extended or adjusted under 35 U.S.C. 154(b) by 616 days.

(21) Appl. No.: 13/294,644

(22) Filed: Nov. 11, 2011

(65) Prior Publication Data

US 2014/0315469 A1 Oct. 23, 2014

(51) Int. Cl.

| | |
|---|---|
| ***A63H 3/46*** | (2006.01) |
| ***A63H 17/00*** | (2006.01) |
| ***A63H 33/00*** | (2006.01) |
| ***A63H 13/10*** | (2006.01) |

(52) U.S. Cl.

CPC ..... *A63H 3/46* (2013.01); *A63H 13/10* (2013.01); *A63H 33/003* (2013.01)

USPC ..... 446/376; 446/95; 446/465

(58) Field of Classification Search

USPC ..... 446/93–99, 203, 279, 320, 321, 376, 446/378, 383, 390, 465, 473, 487

See application file for complete search history.

(56) References Cited

U.S. PATENT DOCUMENTS

| | | | | |
|---|---|---|---|---|
| 112,550 | A | | 3/1871 | Clay |
| 596,109 | A | | 12/1897 | Gedney |
| 1,586,146 | A | | 5/1926 | Fiore |
| 2,251,006 | A | | 7/1941 | Savage |
| 3,638,353 | A | | 2/1972 | Fryc et al. |
| 3,807,085 | A | | 4/1974 | Campbell, Jr. |
| 3,826,039 | A | | 7/1974 | Disko et al. |
| 4,087,931 | A | | 5/1978 | Maurer |
| 4,107,872 | A | | 8/1978 | Tucker et al. |
| 4,248,006 | A | | 2/1981 | Jones et al. |
| 4,454,679 | A | | 6/1984 | Ogawa |
| 4,543,073 | A | | 9/1985 | Matsuda |
| 4,571,203 | A | | 2/1986 | Murakami |
| 4,579,539 | A | | 4/1986 | Ganeff et al. |
| 4,580,993 | A | * | 4/1986 | Ohno ..... 446/376 |
| 4,586,911 | A | | 5/1986 | Murakami |
| 4,599,078 | A | | 7/1986 | Obara |
| 4,623,317 | A | | 11/1986 | Nagano |

(Continued)

FOREIGN PATENT DOCUMENTS

| | | | |
|---|---|---|---|
| CN | 201189398 | U | 2/2009 |
| CN | 201214015 | Y | 4/2009 |

(Continued)

OTHER PUBLICATIONS

CN Office Action for Application No. 201210449492.3. Mailed on Sep. 19, 2014. 5 pages.

(Continued)

*Primary Examiner* — Nini Legesse
(74) *Attorney, Agent, or Firm* — Cantor Colburn LLP

(57) ABSTRACT

A toy is provided, the toy having: an action figure with a pair of appendages movably secured thereto for movement between a first separated position and a second un-separated position; a pair of accessories removably secured to the pair of appendages; and wherein the pair of accessories are configured to be secured to each other and form an item when the pair of appendages are in the second un-separated position and the pair of accessories are secured to the pair of appendages.

20 Claims, 10 Drawing Sheets

(56) References Cited

U.S. PATENT DOCUMENTS

| | | | | | |
|---|---|---|---|---|---|
| 4,626,223 | A | | 12/1986 | Sweet | |
| 4,642,064 | A | | 2/1987 | Yoke | |
| 4,676,763 | A | | 6/1987 | Saito et al. | |
| 4,723,931 | A | | 2/1988 | Allen et al. | |
| 4,732,049 | A | | 3/1988 | Beny et al. | |
| 4,750,895 | A | * | 6/1988 | Shinohara et al. | 446/230 |
| 4,906,215 | A | | 3/1990 | Reiling, Jr. et al. | |
| 4,921,458 | A | | 5/1990 | Greenwood | |
| 5,052,680 | A | | 10/1991 | Malewicki et al. | |
| 5,277,643 | A | * | 1/1994 | Ejima | 446/93 |
| 5,295,889 | A | | 3/1994 | Ejima | |
| 5,615,900 | A | | 4/1997 | Gaportsin | |
| 5,971,832 | A | | 10/1999 | Siboni | |
| 6,824,442 | B2 | | 11/2004 | Andrews et al. | |
| 7,121,917 | B2 | | 10/2006 | Hardouin et al. | |
| 7,686,669 | B2 | | 3/2010 | Sun et al. | |
| 8,066,542 | B2 | * | 11/2011 | Ejima | 446/93 |
| 2004/0212148 | A1 | * | 10/2004 | Losey et al. | 273/138.1 |
| 2006/0270316 | A1 | * | 11/2006 | Campbell et al. | 446/431 |
| 2009/0209168 | A1 | * | 8/2009 | Ejima | 446/93 |
| 2010/0041305 | A1 | * | 2/2010 | O'Connor | 446/308 |
| 2010/0181720 | A1 | | 7/2010 | Barthold et al. | |
| 2010/0304641 | A1 | | 12/2010 | Nakanishi | |

FOREIGN PATENT DOCUMENTS

| | | | |
|---|---|---|---|
| CN | 201565128 | U | 9/2010 |
| CN | 201768362 | U | 3/2011 |
| CN | 202010419 | U | 10/2011 |
| JP | H0623153 | A | 2/1994 |

OTHER PUBLICATIONS

English Translation CN Office Action for Application No. 201210449492.3. Mailed on Sep. 19, 2014. 3 pages.
English Abstract of CN201189398.
English Abstract of CN201214015.
English Abstract of CN201565128.
English Abstract of CN201768362.
English Abstract of CN202010419.
English Abstract of JPH0623153.

* cited by examiner

ACTION FIGURE WITH ACCESSORIES

BACKGROUND

Various embodiments of the present invention relate to a toy and more particularly, a toy figure having articulating portions and accessory items removably secured to the articulating portions.

Children's toys have included miniature cars, boats, trains, figures, etc. wherein the user's imagination provides for hours of extended play and enjoyment. Toy figures that resemble fighting or combat type activities are particularly popular as the user can participate in imaginary battles or action sequences.

Accordingly, it is desirable to provide a toy that has articulating portions and allows for interaction with the user as well as providing numerous configurations.

SUMMARY OF THE INVENTION

In one embodiment, a toy is provided. The toy having: an action figure with a pair of appendages movably secured thereto for movement between a first separated position and a second un-separated position; a pair of accessories removably secured to the pair of appendages; and wherein the pair of accessories are configured to be secured to each other and form an item when the pair of appendages are in the second un-separated position and the pair of accessories are secured to the pair of appendages.

In another embodiment, an action figure and a pair of accessories configured to be removably secured to the action figure is provided, wherein the action figure has a pair of arms and a pair of legs each being movably secured to a body portion of the action figure and wherein the pair of legs and the pair of arms are repositionable such that the action figure is provided with one of a standing position, a kneeling position and a lying position and wherein each of the pair of accessories are configured to be removably secured to one of the pair of arms and the pair of accessories are configured to cooperate with each other to provide an item associated with the action figure.

BRIEF DESCRIPTION OF THE DRAWINGS

Other features, advantages and details appear, by way of example only, in the following description of embodiments, the description referring to the drawings in which:

FIGS. 11A-13 are various views of an accessory according to an alternative embodiment of the present invention;

DETAILED DESCRIPTION

Referring now to FIGS. 1-8C, various exemplary embodiments of a toy 10 are illustrated. In accordance with these exemplary embodiments, portions of the toy as described herein may be formed out of an easily molded material such as plastic or any other equivalent materials. As will be further discussed herein, the toy can be configured into various configurations.

Figure 12A:
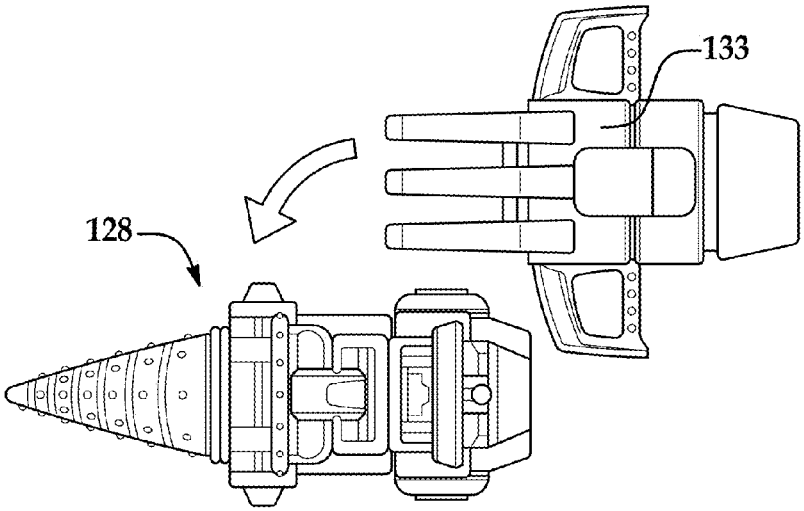
Figure 12B:
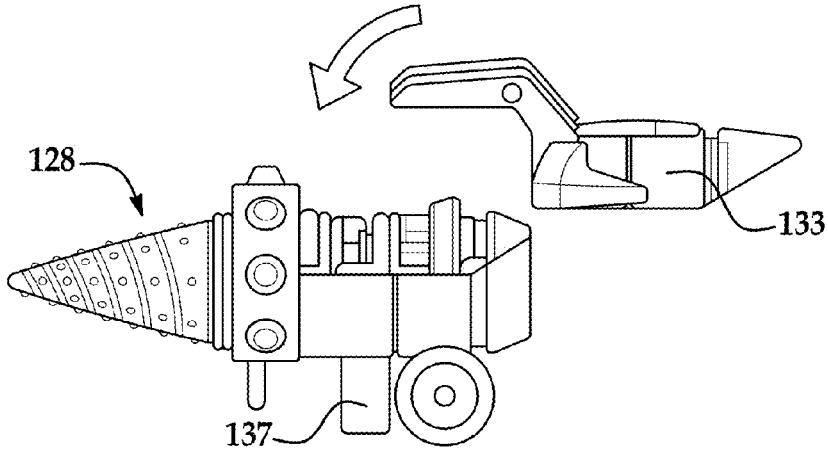
Figure 13:
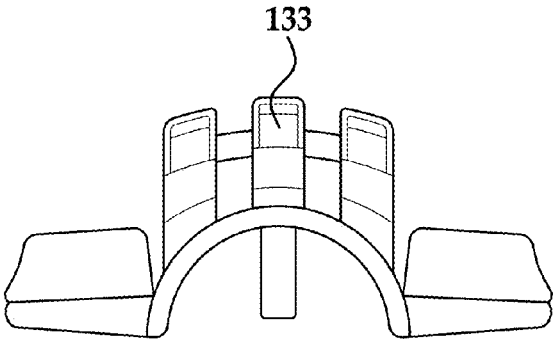

Toy 10 includes an action FIG. 12 and a pair of accessories 14. The pair of accessories are configured to be releasably secured to the action figure as well as each other. In one embodiment, the action FIG. 12 will resemble a human, humanoid, robot, theme character or any other type of configuration. Action FIG. 12 has an upper body portion 16 and a lower body portion 18. The upper portion 16 has a pair of arms or appendages 20 movably secured thereto and the lower portion has a pair of legs or appendages 22 that are movably secured to the lower body portion 18. It is, of course, understood that the pair of arms 20 and pair of legs 22 may be movably secured to any portion of the action FIG. 12. Still further, each of the arms or legs can be further configured with a pivoting joint (e.g., elbow or knee) such that further movement of the same can be provided such that the action figure may be manipulated into numerous configurations.

The pair of arms 20 and the pair of legs 22 are movably or pivotally secured to the action figure at a joint. For example, one non-limiting configuration of the joint is a ball and socket arrangement wherein the ball is insertable into the socket to allow movement therein. Of course, numerous other equivalent joints are contemplated to be within the scope of the various embodiments of the present invention.

In addition, the toy 10 also includes a pair of accessories 14 that are removably secured to the pair of arms or pair of appendages 20 such that as the pair of arms 20 move with respect to the action FIG. 12, appendages 20 will also move. In one exemplary embodiment, each of the pair of accessories 14 will be configured to have a launcher mechanism configured to launch a projectile 26 from the accessory 14 and the appendage it is secured to. One non-limiting example of such a launcher mechanism is a spring biased mechanism that has a spring or biasing member that is compressed as a portion of the projectile is inserted into the appendage. A catch portion of the portion of the projectile inserted into the appendage is engaged by a releasable trigger portion such that as the projectile is inserted into the accessory, the spring is compressed and the catch portion of the projectile is engaged by the trigger. Thus the spring will remain in the compressed state until the trigger is actuated to release the spring force and launch the projectile from the accessory.

In one embodiment, each of the pair of accessories 14 are configured to resemble a drill or drill like device having a drill bit 26 as illustrated in the attached figures. Of course, other configurations are considered to be within the scope of exemplary embodiments of the present invention. In one embodiment, the drill bit is rotationally received within the accessory in order to simulate a drilling action. In addition, the drill bit also serves as the projectile that is launched from the aforementioned spring biased launching mechanism. Still further, each accessory can be configured to releasably engage a distal end or hand portion 27 of each pair of arms or appendages 20.

As illustrated in the attached drawings and in one embodiment, each accessory 14 is configured to couple or align with each other such that when the pair of accessories 14 are positioned adjacent to each other they will form an item or weapon 28 when each of the pair of accessories 14 are in a un-separated configuration illustrated at least in FIGS. 1A-1C and 4B. In one implementation, each accessory 14 may be configured to snap fittingly engage each other such that as they are moved from the separated configuration illustrated in FIG. 4A to the un-separated position illustrated in FIG. 4B complementary features on each of the accessories can be used to assist in the "snap fitting" engagement of each of the accessories 14 to each other to define item 28.

Figure 1:
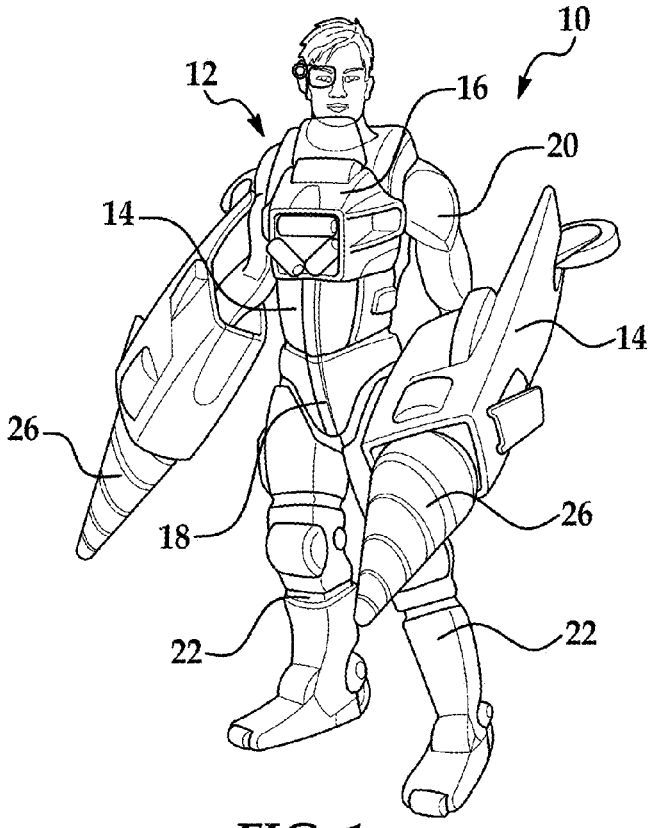
FIG. 1 is a perspective view of a toy in accordance with one embodiment of the present invention.
Figure 1A:
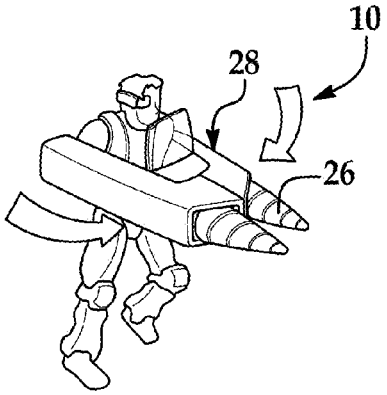
FIGS. 1A-1C illustrate the toy of FIG. 1 in numerous configurations.
Figure 1B:
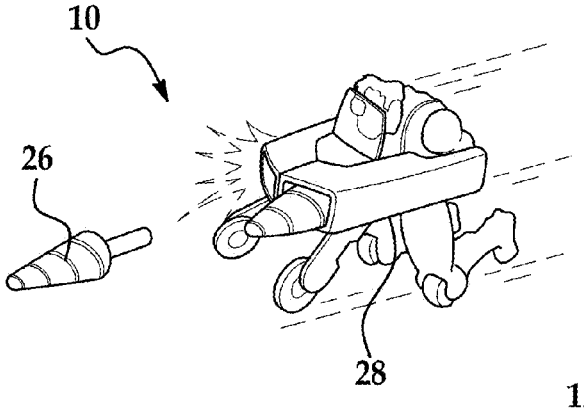
Figure 1C:
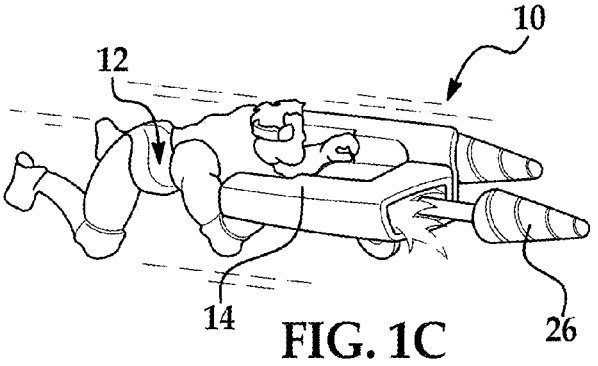
Figure 2:
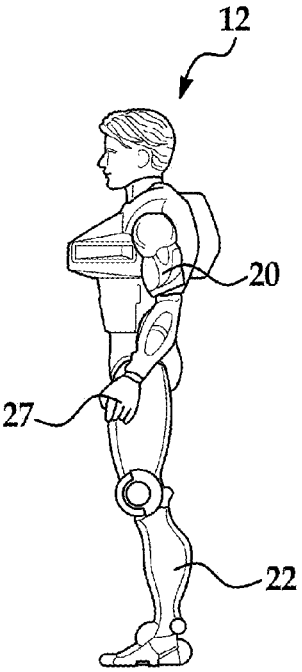
FIG. 2 is a side elevational view of the toy in a standing position without any accessories secured thereto.
Figure 3:
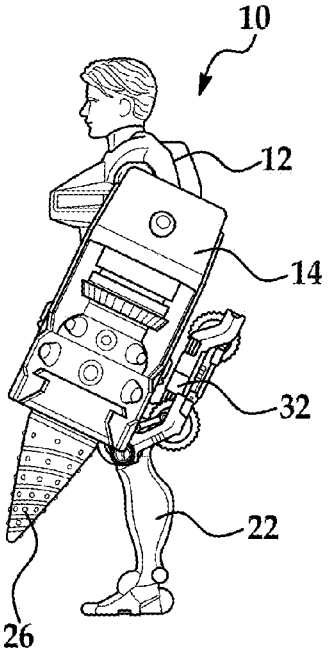
FIG. 3 is a side elevational view of the toy in a standing position with accessories secured thereto.
Figure 4A:
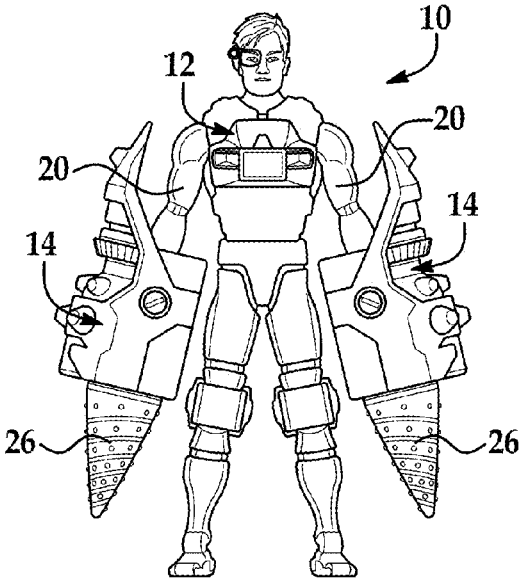
FIG. 4A is a view illustrating the toy and its accessories in a first position.
Figure 4B:
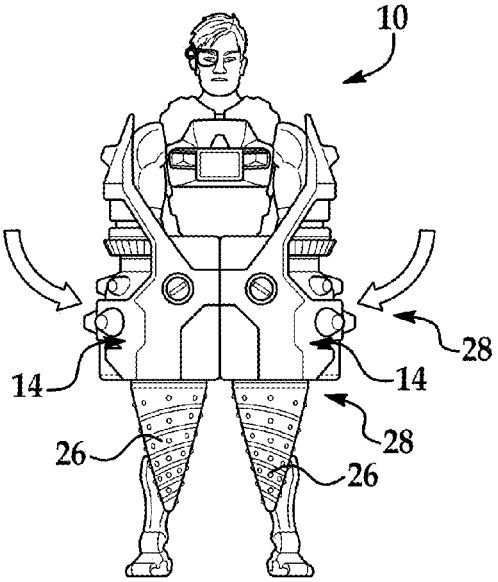
FIG. 4B is a view illustrating the toy and its accessories in a second position.
Figure 5:
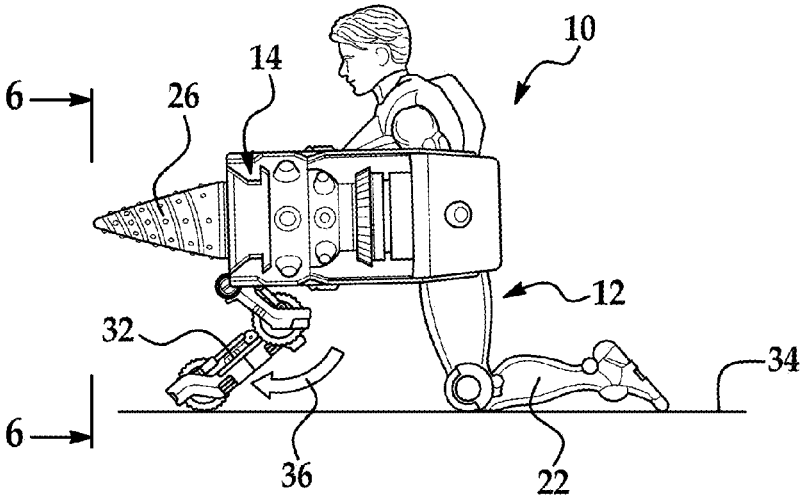
FIG. 5 is a view illustrating the toy and its accessories in a kneeling position.
Figure 6:
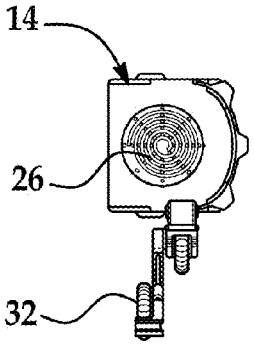
FIG. 6 is a view along lines 6-6 of FIG. 5.

In addition, each accessory 14 further comprises a roller or pair of wheels 32 movably or pivotally secured to the accessory for movement between a first position (See at least FIGS. 7, 8A and 8C) and a second position (See at least FIG. 5). Roller or pair of wheels 32 provides item 28 and/or accessories 14 with a means to facilitate sliding of the same along a surface on which the action figure and the item and/or accessories 14 are situated.

Figure 7:
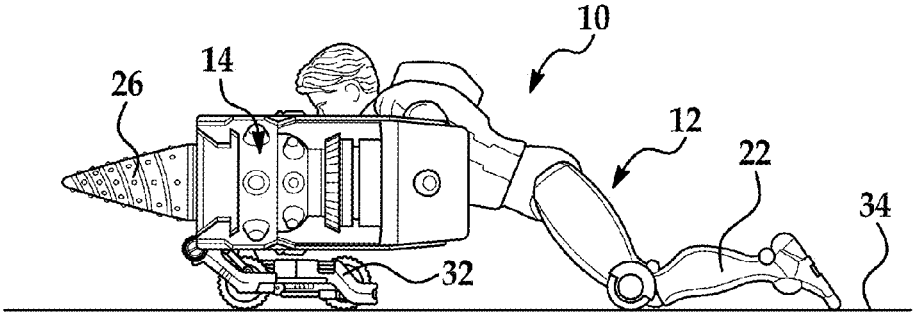
FIG. 7 is a view illustrating the toy and its accessories in a lying position.
Figure 8A:
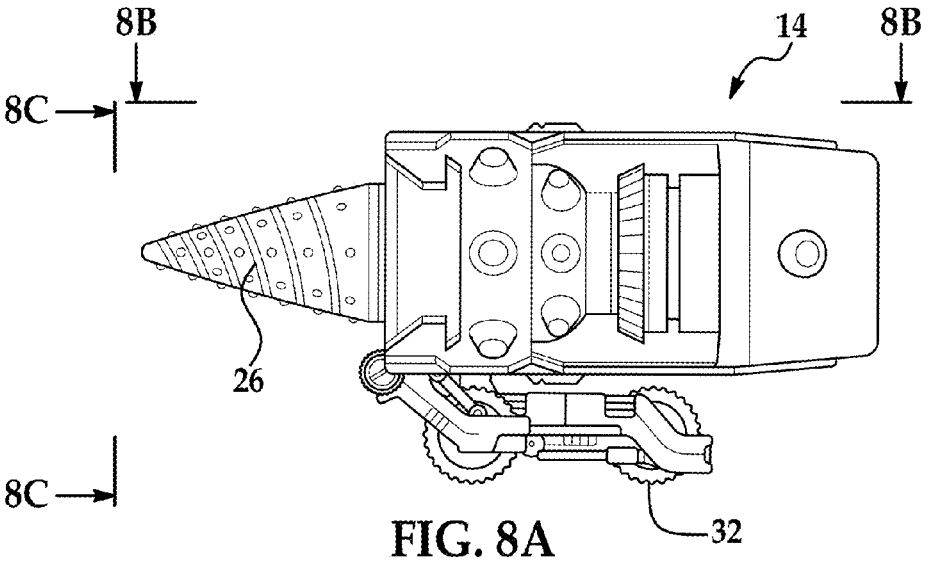
FIG. 8A is a side view of an accessory for the toy.
Figure 8B:
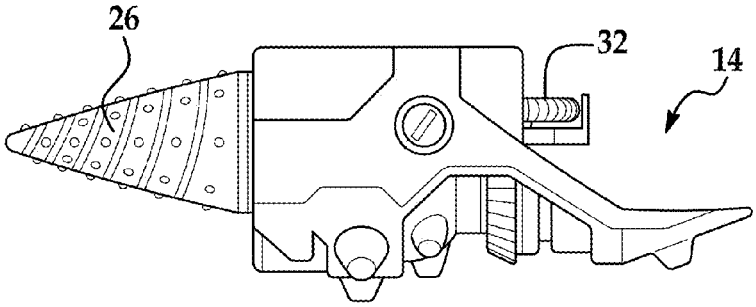
FIG. 8B is a view along lines 8B-8B of FIG. AA.
Figure 8C:
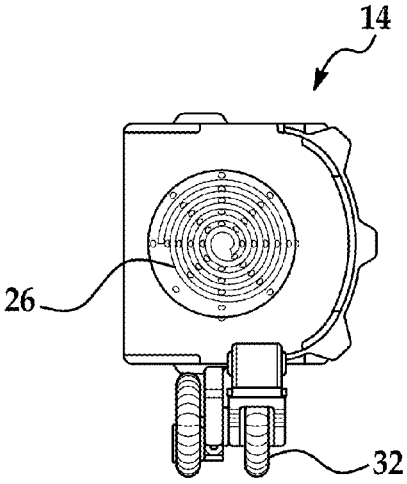
FIG. 8C is a view along lines 8C-8C of FIG. 8A.
Figure 9A:
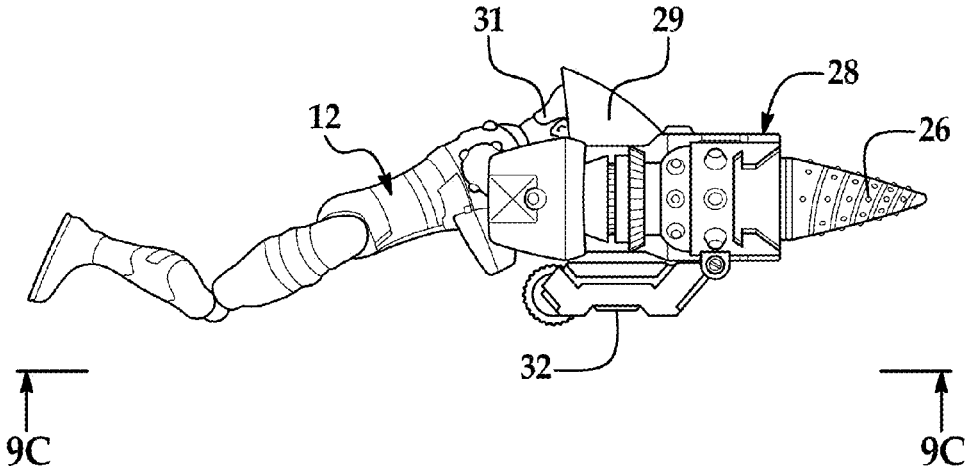
FIGS. 9A-9D are various views of an alternative embodiment of the present invention.
Figure 9B:
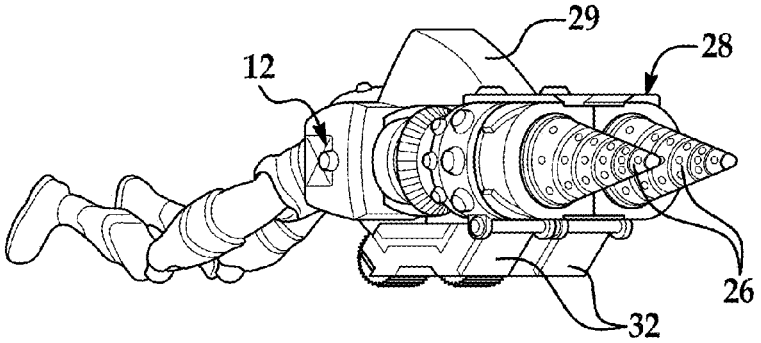
Figure 9C:
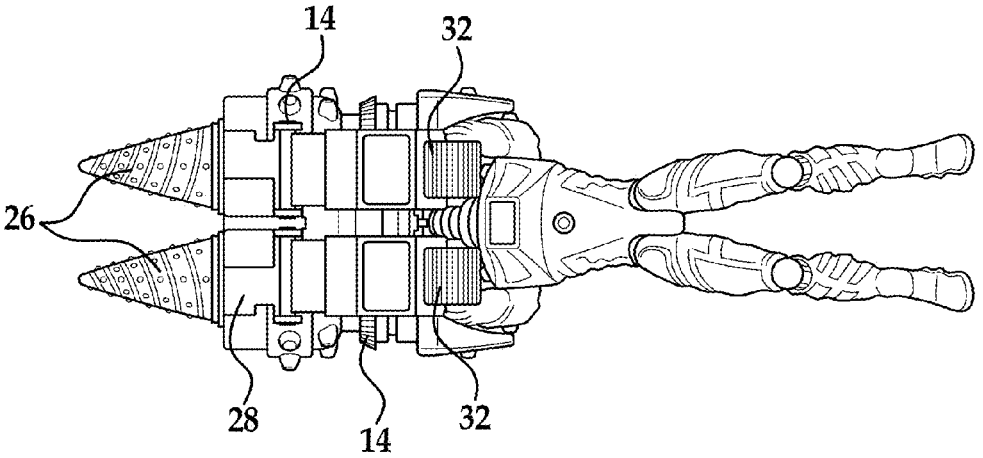
Figure 9D:
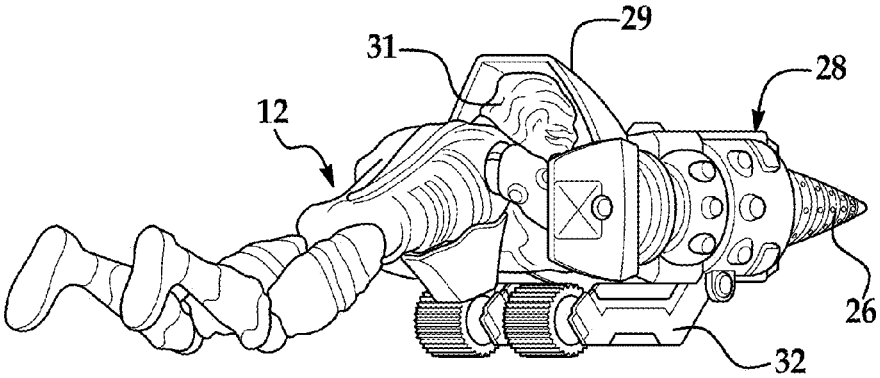

As illustrated and when the roller is in the first position, it will make contact with a surface 34 when the action figure is in a lying position (see at least FIG. 7). When the action figure is moved into a kneeling position, the roller can be pivoted in the direction of arrow 36 to a second position such that at least one wheel of the roller will contact surface 34 when the action figure is in a kneeling position. As mentioned above, roller or pair of wheels 32 helps facilitate the sliding movement of the toy along surface 34. In order to move the roller back to the first position, a user simply pivots or moves it in a direction opposite to arrow 36.

Accordingly and in these two positions, the accessory and/or item defined by the accessories coupled together can be located at two different heights with respect to surface 34 corresponding to the configuration (e.g. lying or kneeling) of the action figure. As such, variations or configurations of the toy can be provided. Moreover, such variations and configurations can simulate different aiming positions of the projectiles 26 that are capable of being launched from the accessory 14.

Referring now to FIGS. 9A-9D, an alternative exemplary embodiment of the present invention is illustrated. Here the item 28 when assembled will further comprise a shield portion or canopy 29 that is configured to shield a head 31 of the action FIG. 12. In one embodiment, the shield portion 29 maybe pivotally secured to item 28 and/or accessories 14. Alternatively, the shield portion 29 is fixedly secured to item 28 and/or accessories 14. Still further, shield portion 29 may comprise a pair of shield portions each being secured to one of the accessories 14 alternatively, a single shield portion 29 maybe secured to only one of the accessories 14.

Figure 10:
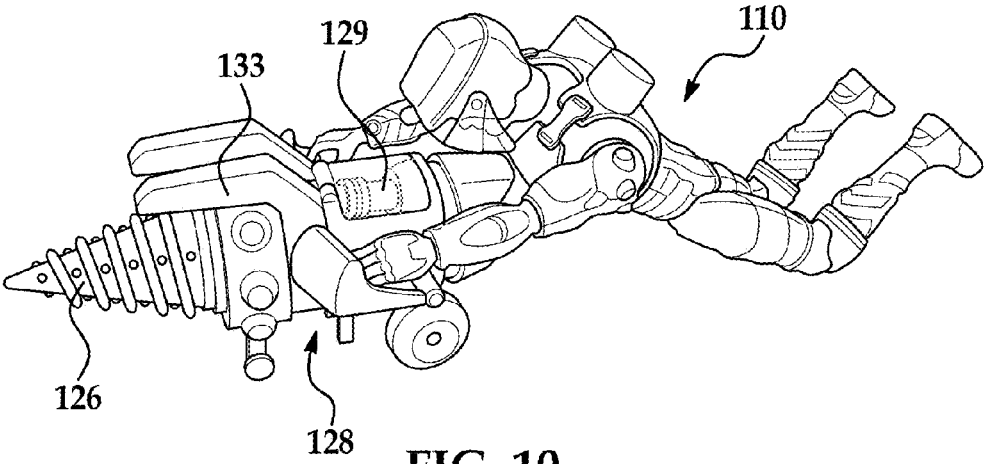
FIGS. 10 and 11 illustrate yet another alternative embodiment of the present invention.
Figure 11:
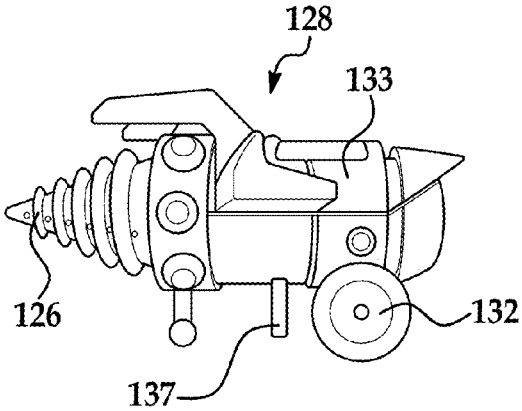
Figure 11A:
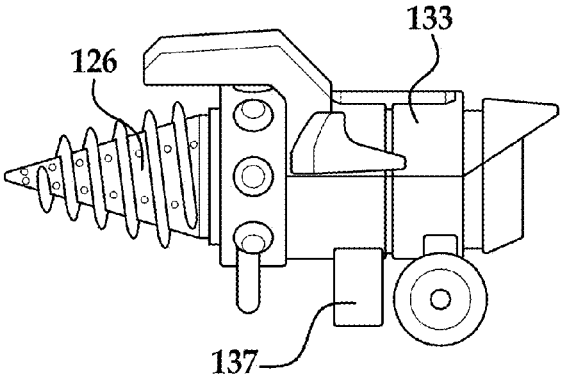
Figure 11B:
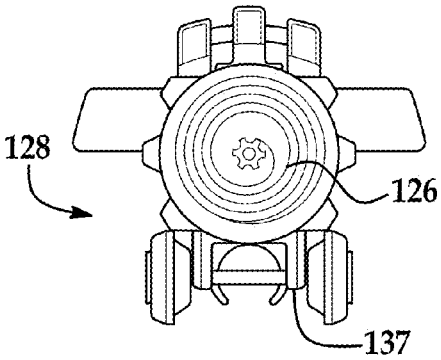
Figure 11C:
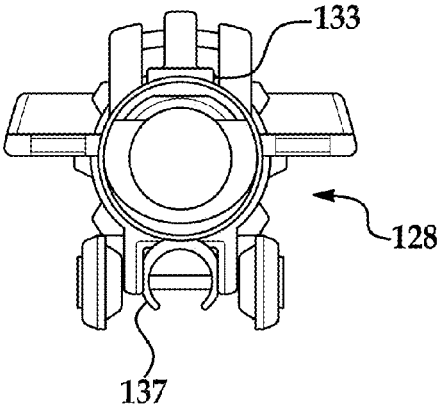
Figure 11D:
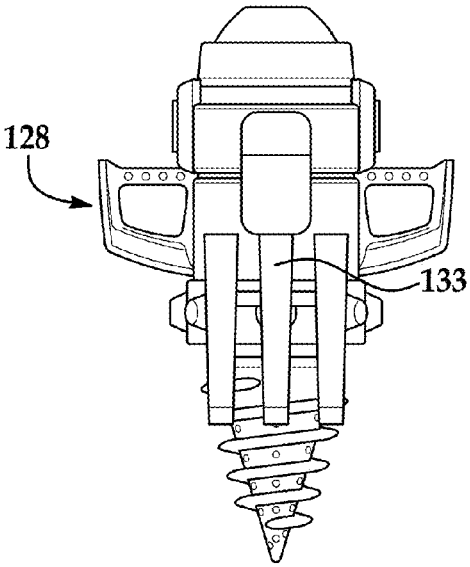
Figure 11E:
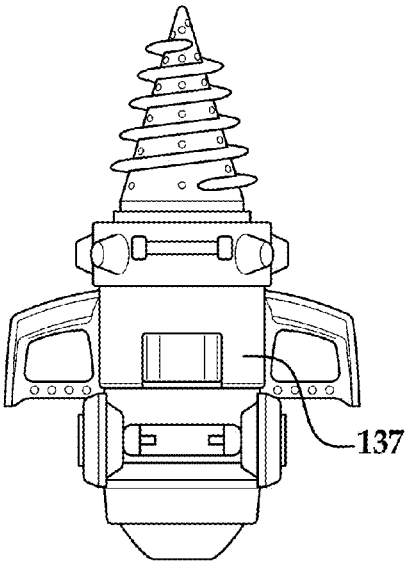

Referring now to FIGS. 10 and 11, yet another alternative embodiment of the present invention is illustrated. Here toy 110 includes an action figure 112 configured for use with an accessory 128. In this embodiment, the accessory 128 is a single component configured to be engaged by at least one or both of the pair of arms of the action figure. In one contemplated embodiment, accessory 128 is configured to resemble a ride behind vehicle. As in the previous embodiments, accessory 128 can be provided with a canopy or shield 129.

Similar to the previous embodiments, the accessory is configured to launch a projectile 126 and has a roller or wheel 132 configured for movement between a first position and a second position and in one embodiment, the accessory is configured to resemble a drill. In this embodiment, accessory 128 may also be configured to have a shield portion 129 pivotally secured to accessory 128. In another variation, the roller or wheel 132 is fixedly secured to accessory 128.

In yet another alternative embodiment and referring now to FIGS. 10-13, an upper housing portion 133 is removably secured to item 128. In this embodiment and when upper housing portion 133 is removed from item 128 the same can be removably secured to a distal end 127 of an arm or appendage 120 of the action figure 112. In order to allow for this removable securement of upper housing portion 133 to the distal end 127 of the arm or appendage 120, a feature 135 configured to engage the distal end or the arm or appendage 120 of the action figure 112 is provided on upper housing portion 133. In addition, accessory 128 is also configured to be removably secured to another one of the arms or appendages 120 of the action figure 112. In similar fashion, accessory 128 has a feature 137 configured to releasably engage the arm or appendage 120 of the action figure 112. In order to facilitate the releasable securement of portion 133 to item 128 each component may have features configured to frictionally (e.g., releasably) engage each other when portion 133 is secured to item 128.

Figure 14A:
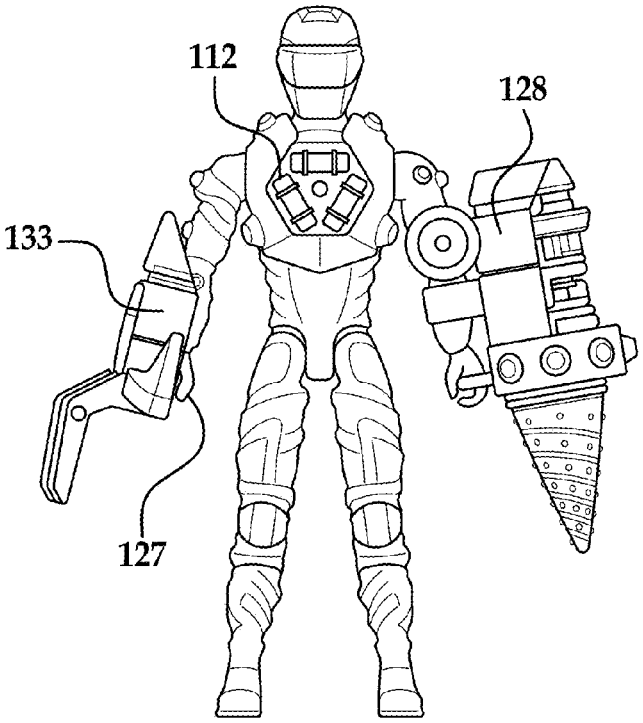
FIGS. 14A-14C illustrate the action figure with an accessory according to an alternative embodiment of the present invention.
Figure 14B:
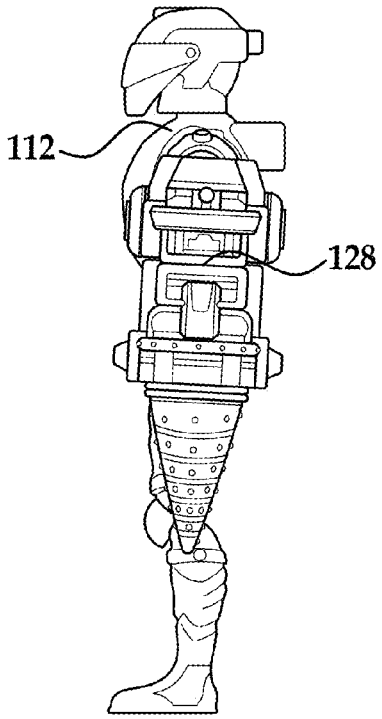
Figure 14C:
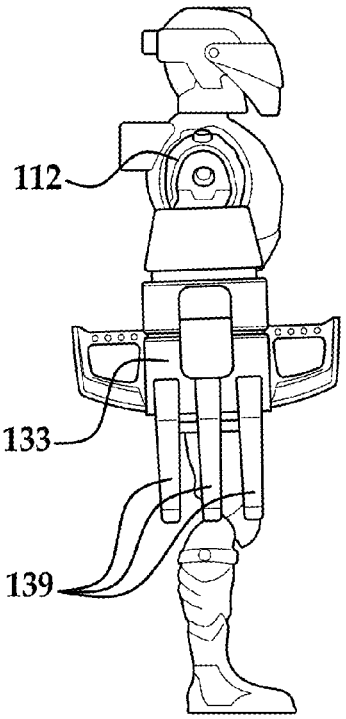

Accordingly, and as illustrated in at least FIGS. 14A-14C, item 128 and item or upper housing portion 133 are also each removably secured to one of a pair of appendages 120 of the action figure 112 such that they can be manipulated into various positions as the pair of appendages are moved with respect to a body portion of the action figure 112. Still further, each of the pair of accessories (e.g., upper housing portion 133 and item 128) are configured to be secured to each other to form an item 128 having a slightly different configuration (see at least FIGS. 11A-11E) than when upper housing portion 133 is removed therefrom.

In addition, and as illustrated in at least FIGS. 14A-14C, upper housing portion 133 is configured to act as a shield when secured to one of the pair of appendages 120 of the action figure 112. In other words, portion 133 when removed from item 128 is releasably secured to one of the pair of appendages such that the action figure 112 is provided with a shield member. In addition and in one embodiment, upper housing portion 133 and/or shield 133 (when secured to one of the pair of appendages 120) can also be configured to have a plurality of features 139 extending therefrom.

Figure 15:
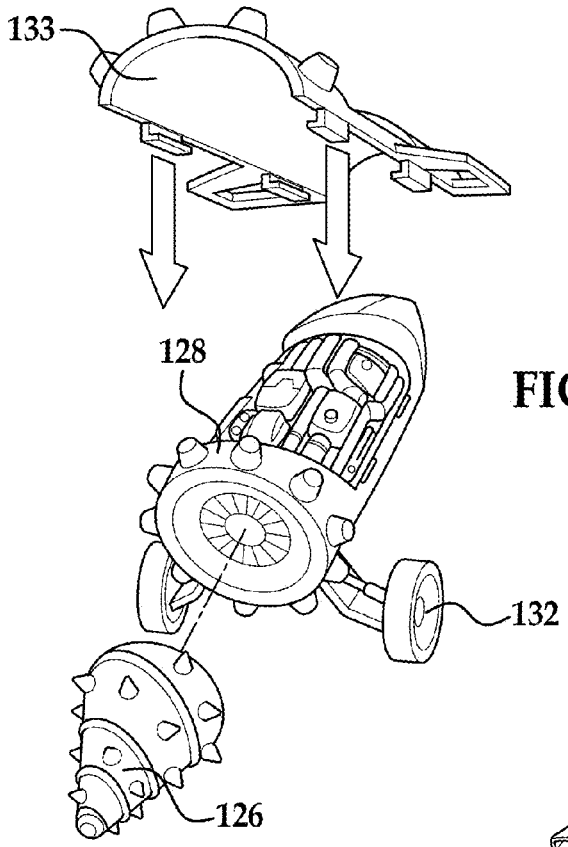
FIGS. 15 and 16 illustrate yet another alternative embodiment of the present invention.
Figure 16:
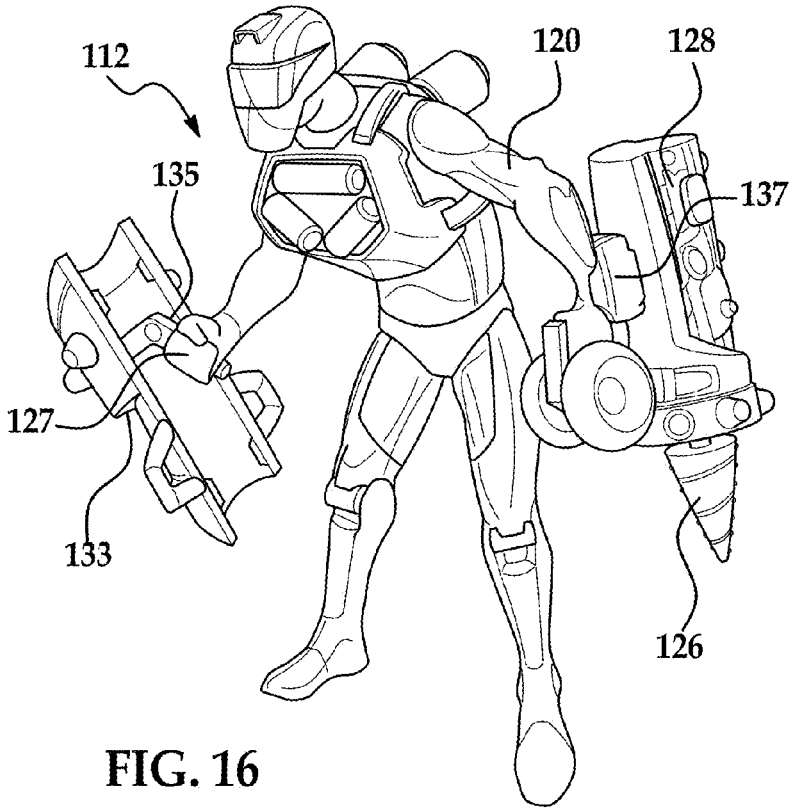

Referring now to FIGS. 15 and 16, yet another alternative embodiment of the present invention is illustrated. In this embodiment, the removable portion 133 or upper housing portion 133 has a different configuration to resemble a shield when secured to one of the appendages 120 of the action figure 112.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A toy, comprising:

an action figure having a pair of appendages movably secured thereto, the pair of appendages configured for movement between a first separated position and a second un-separated position;

a pair of accessories removably secured to the pair of appendages;

wherein the pair of accessories are configured to be secured to each other and form an item when the pair of appendages are in the second un-separated position and the pair of accessories are secured to the pair of appendages; and wherein each of the pair of accessories are directly secured to each other when the pair of appendages are in the second un-separated position and the pair of accessories are secured to the pair of appendages and wherein the pair of accessories are left and right halves of the item formed when the pair of accessories are directly secured to each other.

2. The toy as in claim 1, wherein each of the pair of accessories further comprise a launcher for launching a projectile.

3. The toy as in claim 1, wherein each of the pair of accessories further comprise a roller configured for movement between a first position and a second position.

4. The toy as in claim 3, wherein the first position is a stowed position and the second position is a deployed position, wherein the roller is moved further away from the pair of accessories when it is in the deployed position.

5. The toy as in claim 1, wherein the item is configured to resemble a drill and each of the pair of accessories further comprise a launcher for launching a drill bit from the drill.

6. The toy as in claim 1, wherein the action figure further comprises an upper body portion and a pair of leg members movably secured to the action figure, wherein the pair of arms are movably secured to the upper body portion and the pair of leg members are configured to provide the action figure with a standing position, a kneeling position and a lying position.

7. The toy as in claim 1, wherein the action figure further comprises an upper body portion and a pair of leg members movably secured to the action figure, wherein the pair of arms are movably secured to the upper body portion and the pair of leg members are configured to provide the action figure with a standing position, a kneeling position and a lying position and wherein each of the pair of accessories further comprise a roller configured for movement between a first position and a second position, wherein the roller contacts a surface the action figure rests on when the action figure is in the lying position and the roller is in the first position and wherein the roller contacts the surface when the action figure is in the kneeling position and the roller is in the second position.

8. The toy as in claim 7, wherein the roller is further away from the accessory when it is in the second position.

9. The toy as in claim 8, wherein each of the pair of accessories further comprise a launcher for launching a projectile.

10. The toy as in claim 8, wherein each of the pair of accessories further are configured to resemble a drill and each of the pair of accessories further comprise a launcher for launching a drill bit from the drill.

11. A toy, comprising:

a pair of accessories, wherein the pair of accessories are configured to be removably secured to each other to form a first item when the pair of accessories are secured to each other and a pair of separate items when the pair of accessories are not secured each other, wherein each of the pair of accessories are also removably secured to a portion of an action figure when they are secured to each other and separated from each other.

12. In combination, an action figure and a pair of accessories configured to be removably secured to the action figure, wherein the action figure has a pair of arms and a pair of legs each being movably secured to a body portion of the action figure and wherein the pair of legs and the pair of arms are repositionable such that the action figure is provided with one of a standing position, a kneeling position and a lying position and wherein each of the pair of accessories are configured to be removably secured to one of the pair of arms and the pair of accessories are configured to be removably secured to each other to form an item associated with the action figure; and wherein each of the pair of accessories are directly secured to each other when the item is formed by the pair of accessories and wherein the pair of accessories are left and fight halves of the item formed when the pair of accessories are directly secured to each other.

13. The action figure and pair of accessories as in claim 12, wherein one of the pair of accessories further comprises a launcher for launching a projectile and the other one of the pair of accessories is configured to resemble a shield.

14. The action figure and pair of accessories as in claim 12, wherein each of the pair of accessories further comprise a roller configured for movement between a stowed position and a first deployed position.

15. The action figure and pair of accessories as in claim 12, wherein the item is configured to resemble a drill and each of the pair of accessories further comprise a launcher for launching a drill bit from the drill.

16. The action figure and pair of accessories as in claim 12, wherein each of the pair of accessories further comprise a roller configured for movement between a first position and a second position.

17. The action figure and pair of accessories as in claim 16, wherein the roller is further away from the accessory when it is in the second position.

18. The action figure and pair of accessories as in claim 12, wherein each of the pair of accessories further comprise a roller configured for movement between a stowed position, a first position and a second position, wherein the roller contacts a surface the action figure rests on when the action figure is in the lying position and the roller is in the first position and wherein the roller contacts the surface when the action figure is in the kneeling position and the roller is in the second position.

19. The action figure and pair of accessories as in claim 18, wherein each of the pair of accessories further comprise a launcher for launching a projectile.

20. The action figure and pair of accessories as in claim 18, wherein each of the pair of accessories further are configured to resemble a drill and each of the pair of accessories further comprise a launcher for launching a drill bit from the drill.

* * * * *